United States Patent [19]

Mizutani et al.

[11] 4,268,182

[45] May 19, 1981

[54] DEVICE FOR DETECTING TRAVEL CONDITION OF INKRIBBON FOR PRINTERS

[75] Inventors: Nagao Mizutani, Hachiouji; Yasuo Okawara, Sayama; Toshikazu Shimazaki, Tanashi, all of Japan

[73] Assignee: Citizen Watch Co., Ltd., Tokyo, Japan

[21] Appl. No.: 63,778

[22] Filed: Aug. 6, 1979

Related U.S. Application Data

[63] Continuation of Ser. No. 834,295, Sep. 19, 1977, abandoned.

[30] Foreign Application Priority Data

Sep. 28, 1976 [JP] Japan ..... 51-115054

[51] Int. Cl.[3] ..... B41J 35/36

[52] U.S. Cl. ..... 400/247; 400/249; 400/196.1; 226/11; 226/45

[58] Field of Search ..... 226/11, 45; 400/195, 400/196, 196.1, 235, 234, 249, 583.2, 616.2, 616.3, 328; 335/205, 206; 340/670, 675, 676

[56] References Cited

U.S. PATENT DOCUMENTS

| | | | |
|---|---|---|---|
| 3,354,822 | 11/1967 | Dollot | 400/225 |
| 3,404,628 | 10/1968 | Lee | 400/249 |
| 3,611,343 | 10/1971 | Schoenbach | 340/670 |
| 3,633,804 | 1/1972 | Kitazawa | 226/11 |
| 3,665,844 | 5/1972 | Clark | 226/11 |
| 3,674,192 | 7/1972 | Gottschall | 226/11 |
| 3,818,393 | 6/1974 | Morgott | 335/206 |
| 3,904,018 | 9/1975 | Denley | 400/196 |
| 3,917,142 | 11/1975 | Guarderas | 400/583.2 |
| 3,939,957 | 2/1976 | Bittner | 400/236 |
| 3,949,856 | 4/1976 | Ulber et al. | 226/11 |
| 3,998,313 | 12/1976 | Hickey | 400/616.2 |
| 4,084,680 | 4/1978 | Deetz | 400/144.2 |
| 4,091,913 | 5/1978 | Ku et al. | 400/124 |

FOREIGN PATENT DOCUMENTS

| | | | |
|---|---|---|---|
| 2646336 | 4/1978 | Fed. Rep. of Germany | 400/24 G |
| 628003 | 10/1978 | U.S.S.R. | 400/24 G |

*Primary Examiner*—William Pieprz

*Attorney, Agent, or Firm*—Sherman & Shalloway

[57] ABSTRACT

A device for detecting a travel condition of an inkribbon for printers is disclosed. The device is composed of a rotary member rotatable in response to the travel of the inkribbon and a signal generation means interlocked with the rotary member. The signal generation means generates a detection signal and can not only detect trouble of the detection device but also detect a mode in operation of a carrier on which the detection device is arranged as well as detect the travel of the inkribbon.

9 Claims, 9 Drawing Figures

DEVICE FOR DETECTING TRAVEL CONDITION OF INKRIBBON FOR PRINTERS

BACKGROUND OF THE INVENTION

1. Field of the Invention

This invention relates to printers and more particularly to a printer comprising a device for detecting a travel condition of an inkribbon.

2. Description of the Prior Art

Heretofore it has been the common practice to check a travel condition of an inkribbon for a printer by lightly urging a tension type detection member against the inkribbon stretched under tension across a carrier and detecting an amount of tension subjected to the inkribbon, thereby detecting a trouble induced in an inkribbon tranferring mechanism. That is, as shown in FIG. 1, a detection member a has one end supported by a carrier b and another free end urging a loop of inkribbon e located outside a ribbon cassette d outwardly by means of a spring c. In this case, if the detection member a is displaced in a direction of reducing the loop of inkribbon e inwardly against the action of spring c, the detection member a becomes engaged with a detection switch f secured to the carrier b so as to deliver an electrical signal therefrom, thereby detecting the trouble induced in the inkribbon transferring mechanism.

Such prior art devices, however, can only detect an abnormally large tension subjected to the inkribbon, so that it is impossible to detect troubles that tend to be induced even when the abnormally large tension is not subjected to the inkribbon, for example, a breakage of the inkribbon, separation of a joint between adjacent inkribbons, trouble induced in the inkribbon transferring mechanism, etc. In addition, such prior art device cannot detect trouble induced in the detection device itself and hence it is impossible to detect trouble of the inkribbon which is induced when the detection device is out of order.

As a result, the prior art device has had several drawbacks:

In the first place, the device could not detect the breakage of inkribbon or the separation of the joint between adjacent inkribbons, so that even when a printer functions to impact a desired letter or symbol with a record medium, the absence of the inkribbon results in no imprint on the record medium.

Secondly, whe an inkribbon transferring mechanism for feeding a long inkribbon for the purpose of alleviating the difference between concentrations of characters imprinted on the record medium malfunction and hence the inkribbon stops, such stopped condition of the inkribbon cannot be detected. As a result, a portion of the stopped inkribbon is located between a printer head and the record medium, so that the character imprint impacted on the record medium becomes gradually obscure such that the character imprint could not be deciphered and finally disappears. In addition, there is a risk of the inkribbon being broken by impacting the printer head and platen thereon.

Furthermore, the prior art device cannot detect a trouble induced in the printer head carrier.

SUMMARY OF THE INVENTION

A main object of the invention, therefore, is to provide a useful device for detecting a travel condition of an inkribbon for printers, which can eliminate the above mentioned drawbacks which have been encountered with prior art printers.

Another object of the invention is to provide an improved detection device for printers, which can precisely detect a travel condition of an inkribbon.

Further object of the invention is to provide a novel detection device for printers, which can also detect an operative condition of a device itself for detecting a travel condition of an inkribbon.

A still further object of the invention is to provide a detection device for printers, which can also detect an operative condition of a carrier for printers.

Another object of the invention is to provide a detection device for printers, which is arranged near the front end of a printer head and which can detect a trouble at an early time time within which a character imprint is still kept under a good condition.

A feature of the invention is the provision, in a printer comprising an inkribbon and means for transferring the inkribbon, of the improvement comprising a device for detecting a travel condition of the inkribbon and including (a) a rotary member rotatable in response to the travel of the inkribbon and (b) a signal generation means interlocked with the rotary member and for generating a detection signal.

Other objects and features of the invention will now be described in greater detail with reference to the accompanying drawings.

PREFERRED EMBODIMENTS OF THE INVENTION

Figure 1:
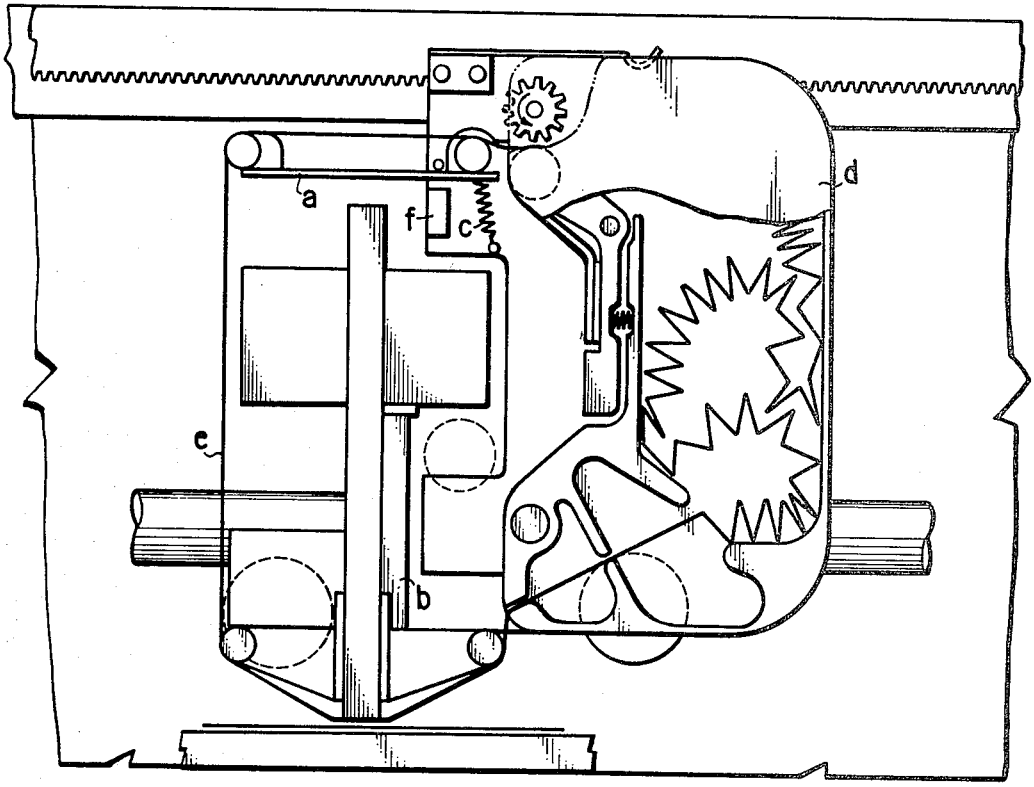
FIG. 1 (PRIOR ART)
FIG. 1 is a schematic plan view of a printer provided with a prior art tension type detection device.
Figure 2:
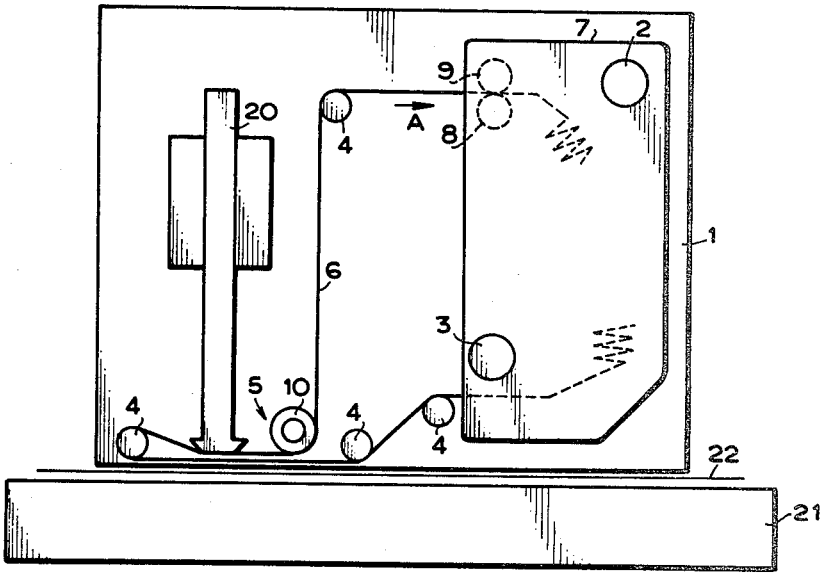
FIG. 2 is a schematic plan view of one embodiment of a device for detecting a travel condition of an inkribbon for printers according to the invention.
Figure 3:
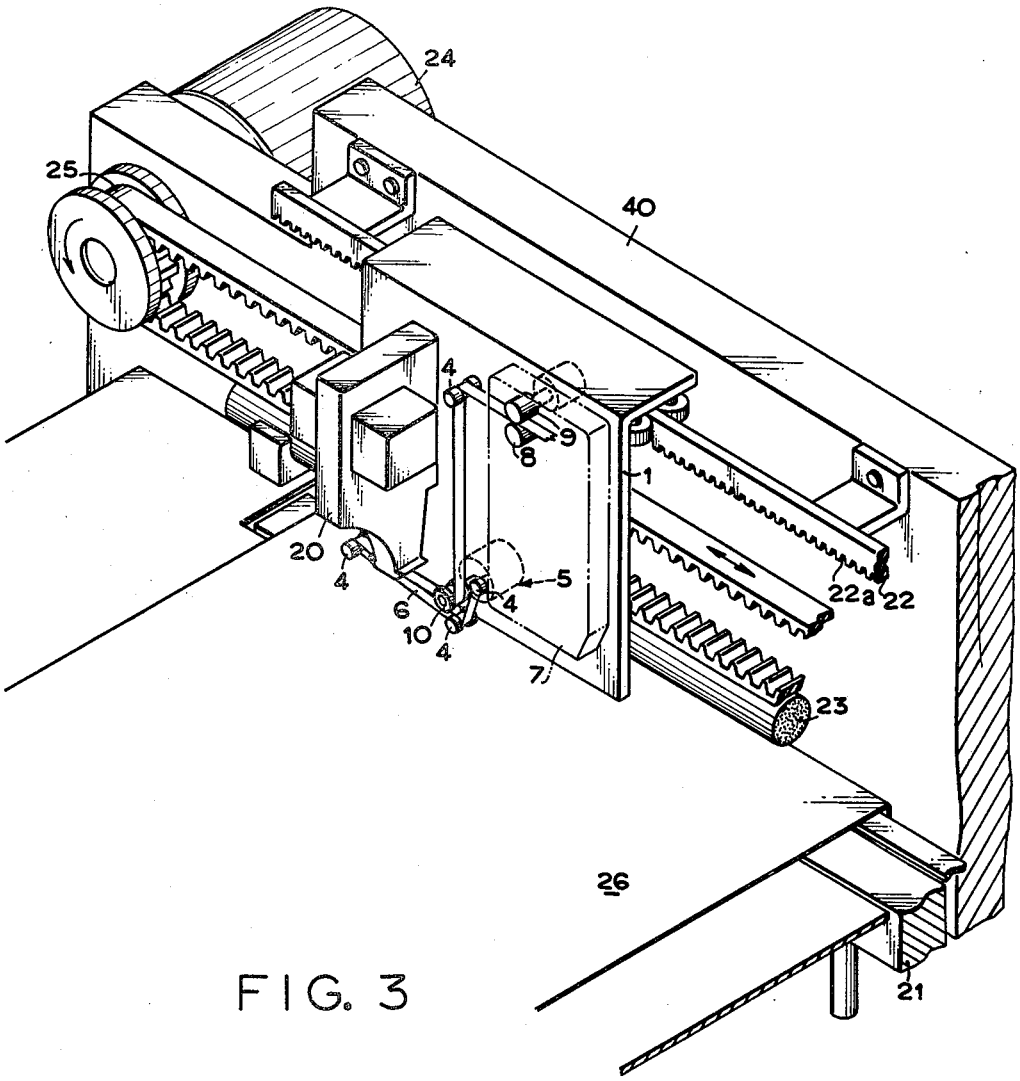
FIG. 3 is a partial perspective view showing the device of FIG. 2.

Referring to FIGS. 2 and 3, a reciprocating carrier 1 is guided by a plurality of guide members 22, 23 arranged across a part of a printer body 40 and secured to a driving member 25 connected to a pulse motor as a prime mover. On the reciprocating carrier 1 are arranged a ribbon cassette 7 detachably mounted thereon with the aid of fixed pins 2, 3 and a plurality of guide rollers 4. The carrier 1 engages with racks **22*a* formed on a part of the guide member 22 and extending across a part of the printer body 40 and is provided with one way clutch (not shown) incorporated therein and for transferring an inkribbon 6 when the carrier 1 is forwardly moved. On the carrier 1 are arranged a driving roller 9 which is rotated when the carrier 1 is forwardly moved and functions to transfer the inkribbon 6, a device for detecting a travel condition of the inkribbon 6 as designated by a reference numeral 5 and shown in detail in FIG. 4, and a printer head 20. A reference numeral 21 designates a conventional platen mounted on a printer body 40 (FIG. 3). Between the platen 21 and the printer head 20 is arranged a record medium 26 such as a record sheet, etc. stretched across the printer body 40. In the ribbon cassette 7 is incorporated the inkribbon 6 under an irregular and endless loop condition. The ribbon cassette 7 is detachably mounted on the carrier 1 with the aid of the fixed pins 2, 3 projected from the carrier 1. The endless inkribbon 6 is delivered from the ribbon cassette 7 and engages with the plurality of guide rollers 4, a rotary member 10 to be described later, and the printer head 20, thereby travelling between the printer head 20 and the record medium 26. The inkribbon 6 is sandwiched between a driven roller 8 rotatably journaled in the ribbon cassette 7 and a driving roller 9 exending through the ribbon cassette 7 and connected to a driving motor. When the driving roller 9 is rotated, the inkribbon 6** is transferred in a direction shown by an arrow A.

Figure 4:
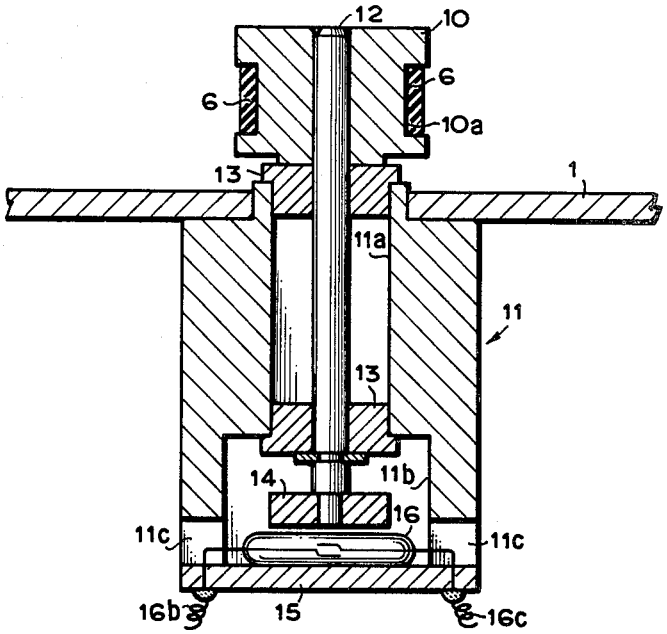
FIG. 4 is an enlarged longitudinal sectional view of one embodiment of a detection means used in the device of FIG. 2.

The device 5 for detecting the travel condition of the inkribbon 6 will now be described with reference to FIG. 4. The detection device 5 comprises a cylindrical body 11 composed of a reduced inner diameter portion 11*a* and an enlarged inner diameter portion 11*b* which is provided at its lower end surface with two grooves 11*c* diametrically opposed with each other. The detection device 5 is secured through its reduced inner diameter portion 11*a* to the carrier 1. A shaft 12 is extended through the cylindrical body 11 and aligned with a center axis thereof. That is, the shaft 12 is rotatably journaled in two bearings 13 secured to the upper and lower ends of the reduced inner diameter portion 11*a*. An upper end of the shaft 12 is projected out of the carrier 1. To this upper projected end of the shaft 12 is secured a rotary member 10. To the lower end of the shaft 12 is secured a square-shaped permanent magnet 14 which constitutes a part of a signal generation means to be described later. The rotary member 10 is provided around its periphery with a guide groove 10*a* which functions to prevent the inkribbon 6 from being slipped away from the rotary member 10, thereby smoothly transferring the inkribbon 6. The guide groove 10*a* has a width which is slightly larger than that of the inkribbon 6 such that the inkribbon 6 is brought into frictional engagement therewith.

Figure 5A:
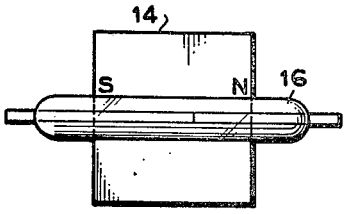
FIG. 5A is an enlarged base view of means for generating a detection signal and used in the detection means of FIG. 4, showing a closed condition of a reed switch.
Figure 5B:
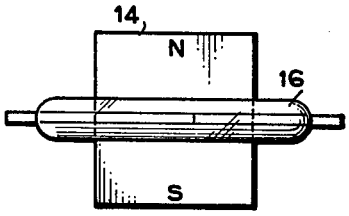
FIG. 5B is an enlarged base view similar to FIG. 5A, but showing an open condition of the reed switch.

As shown in FIGS. 5A and 5B, the permanent magnet 14 is so magnetized that N and S poles are opposed with each other with respect to the center axis of the shaft 12. The lower end of the enlarged inner diameter portion 11*b* of the cylindrical body 11 is closed by a print circuit substrate 15. To the print circuit substrate 15 is secured a reed switch 16 which together with the permanent magnet 14 constitute the signal generation means. The reed switch 16 is extended in its lengthwise direction and has its ends opposed to the grooves 11*c*, respectively. The reed switch 16 has two contact points located at the center axis of the cylindrical body 11 and two terminals 16*b*,16*c* connected to a preset counter 35 shown in FIG. 6.

The operation of the device for detecting the travel condition of the inkribbon according to the invention will now be described.

At first, a power supply switch is turned on and the motor 24 is energized so that the driving roller 9 may be operated and thereby the carrier 1 being driven.

Then, the motor for the driving roller 9 is energised to rotate the driving roller 9 which causes the inkribbon 6 to travel in the direction shown by the arrow A. Then, the rotary member 10 frictionally engaged with the inkribbon 6 becomes rotated in response to the travel of the latter. The rotation of the rotary member 10 is transmitted through the shaft 12 to the permanent magnet 14 thereby rotating it. If the permanent magnet 14 is rotated for 90°, the N and S poles thereof arrive at a position shown in FIG. 5A where the N and S poles are aligned with the lengthwise direction of the reed switch 16, thereby closing it. If the permanent magnet 14 is further rotated for 90°, the N and S poles thereof arrive at a position shown in FIG. 5B where the N and S poles are perpendicular to the lengthwise direction of the reed switch 16, thereby opening it. That is, one rotation of the permanent magnet 14 causes the N and S poles thereof to align with the lengthwise direction of the reed switch 16 for two times, that is, causes the reed switch 16 to close for two times. As a result, during the travel of the inkribbon 6, the rotations of the rotary member 10 cause the reed switch 16 to close twice the number of rotations of the rotary member 10, thereby delivering a periodic signal.

Figure 6:
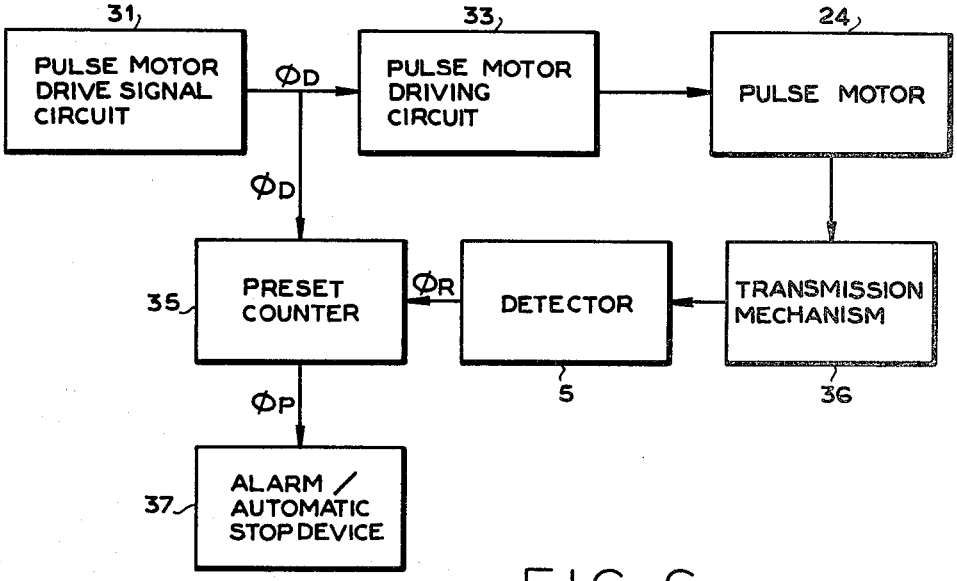
FIG. 6 is a block diagram showing a detection system for illustrating the detection device according to the invention.

An embodiment of a device for detecting a trouble induced in the inkribbon, which is composed of a device for detecting the travel condition of the inkribbon according to the invention and a printer body will now be described with reference to FIGS. 6 and 7.

At first, the printer is operated to energize a pulse motor drive signal circuit 31. The circuit 31 functions to deliver a pulse motor drive signal $\phi D$ to a pulse motor driving circuit 33 and to a preset counter 35. The pulse motor drive signal $\phi D$ is programmed in a steady state so as to form a pulse t' having equal intervals of time of 2.5 milliseconds. The signal $\phi D$ becomes a pulse having equal intervals of time t when a pulse motor 24 is started and stopped by taking slow-up and slow-down into consideration. The pulse motor driving circuit 33 when received the signal $\phi D$ delivered from the pulse motor driving signal circuit 31 functions to deliver a driving signal which causes a pulse motor 24 to drive. The pulse motor 24 when driven functions to transmit a mechanical energy to a transmission mechanism 36, thereby operating it. The transmission mechanism 36 when operated functions to travel the inkribbon 6, thereby operating the detection device shown in FIG. 6 as a detector 5. A diameter of the peripheral groove 10*a* of the rotary member 10 engaged with the inkribbon 6 is designed such that the rotary member 10 rotates under its steady state one turn every 80 milli seconds. As a result, the reed switch 16 in its steady state is closed one time for every 40 milliseconds to deliver a reset signal $\phi R$ to a preset counter 35. The preset counter 35 is preset so as to deliver a preset counter signal $\phi P$ to an alarm or automatic stop device 37 when the preset counter 35 counts 32 pulses of the pulse motor drive signal $\phi D$. If one pulse of the reset signal $\phi R$ delivered from the detector 5 is supplied as an input to the preset counter 35, a count value of the preset counter 35 becomes zero to start a new counting operation. As a result, no preset counter signal $\phi P$ is delivered as an input to the automatic stop device 37. But, if the detector 5 does not deliver the reset signal $\phi R$ on the preset counter 35, that is, if the inkribbon 6 is not travelled under its normal condition due to some trouble and hence the rotary member 10 is not rotated, the preset counter 35 functions to count given numbers and then deliver the preset counter signal $\phi P$ as an input to the alarm or automatic stop device 37 to cause it to operate. As a result, an operator is informed of at least abnormal travelling condition of the inkribbon 6.

In the case of slow-up and slow-down at the time of starting and stopping the pulse motor 24, the intervals of pulse of the pulse motor drive signal $\phi D$ becomes long to cause the counting time long. In this case, however, the transmission mechanism 36 functions to drive the inkribbon 6, thereby reducing the rotating speed of the rotary member 10. As a result, the intervals of time of delivering the reset signal $\phi R$ become longer than 40 milliseconds. Thus, it is possible to maintain the relationship between the resetting and the counting at the time of slow-up and slow-down under the steady state, that is, if the intervals of resetting become long, the intervals of counting become also long. The alarm or automatic stop device 37 when it receives the preset counter signal $\phi P$ delivered from the preset counter 35 functions as a device for alarming the operator or as a device for automatically stopping the printer.

The mode of notifying the operator that the inkribbon 6 is travelling and that the inkribbon 6 becomes stopped due to trouble will now be described in greater detail with reference to FIGS. 7A and 7B.

Figure 7A:
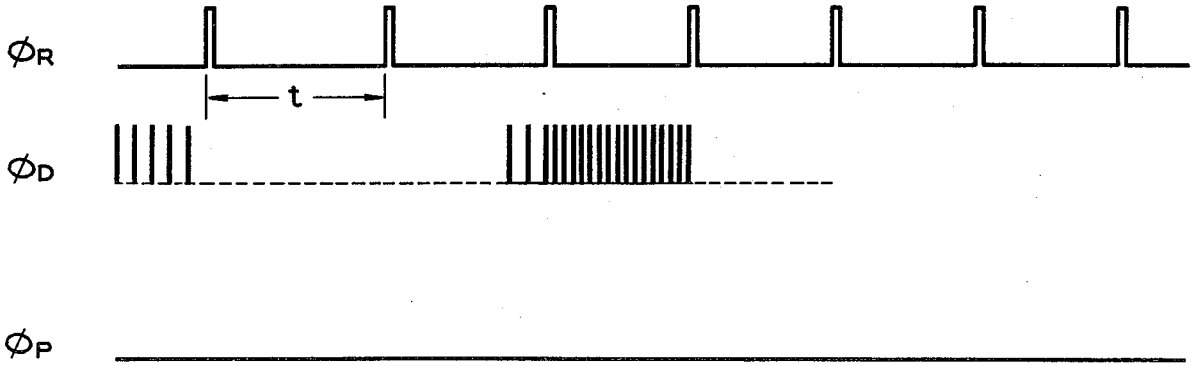
FIGS. 7A and 7B are wave form diagrams illustrating signals delivered from various circuit elements shown in FIG. 6.

In FIG. 7A are shown wave forms produced when the inkribbon 6 is travelling under steady state. The detector 5 functions to deliver the reset signal $\phi R$ one time every 40 milliseconds. The preset counter 35 functions to count 32 pulses of the pulse motor drive signal $\phi D$ by taking 80 milli seconds. That is, the detector 5 functions to deliver the reset pulse $\phi R$ within 80 milliseconds during which the preset counter 35 functions to count 32 pulses of the pulse motor drive signal $\phi D$. Thus, it is impossible to deliver the output signal $\phi P$ from the alarm or automatic stop device 37 prior to counting of 32 pulses of the pulse motor drive signal $\phi D$ by the preset counter 35. During the normal travel of the inkribbon 6, the above mentioned operation is repeated and hence the signal $\phi P$ is not delivered as an input to the alarm or automatic stop device 37, thereby detecting the travel condition of the inkribbon 6. At the time of slow-up and slow-down, the intervals of delivering the reset signal $\phi R$ and pulse motor drive signal $\phi D$ become longer than the above mentioned values. In this case, however, the detection operation is effected in the same manner as that under steady state owing to the above described reasons.

Figure 7B:
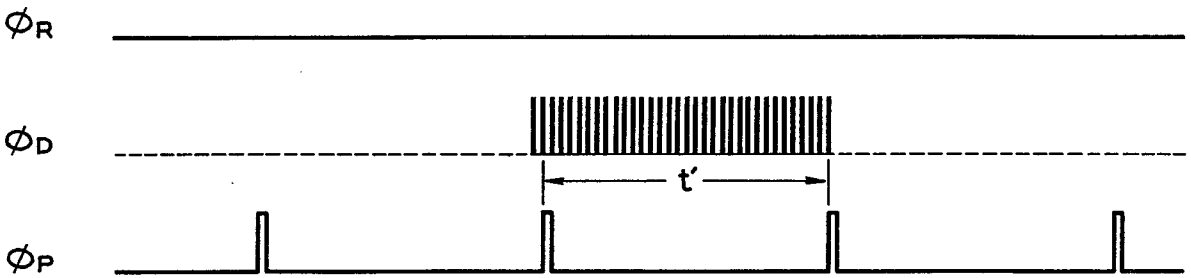

In FIG. 7B are shown wave forms produced when the travel of inkribbon 6 becomes stopped owing to trouble induced therein. The travel stop of the inkribbon 6 results in an absence of the reset signal $\phi R$ delivered as an output from the detector 5. As a result, the preset counter 35 functions to complete counting of 32 pulses of the pulse motor drive signal $\phi D$, so that the preset counter 35 functions to deliver the signal $\phi P$ to the alarm or automatic stop device 37 which when received the signal $\phi P$ functions to alarm the operator causing him to stop the operation of the printer or to automatically stop the operation of the printer. Such detection that the inkribbon 6 becomes stopped renders it possible to rapidly stop the driving operation of the printer.

If the permanent magnet 14 is aligned so that the magnetic force causes the reed switch 16 to close so as to deliver the reset signal $\phi R$, the reed switch 16 is kept closed by the magnetic force even when it is subjected to an exterior force such as cecillations, etc. As a result, there is no risk of the reset signal $\phi R$ being erroneously delivered from the detector 5, thereby preventing an erroneous operation of the alarm or automatic stop device 37.

When the carrier 1 returns the travel of the ribbon 6 is stopped by means of the one-way clutch so that the detecting mechanism 5 does not operate. However, there is actually connected between the pulse motor drive signal circuit 31 and the alarm atomatic stop device a known gate circuit which detects the returning operation of the carrier 1 so as to prevent the signal $\phi D$ from being delivered.

In the above described embodiment, the angle formed between one portion of the inkribbon 6 engaged with the rotary member 10 which enters thereinto and the other portion thereof which is delivered therefrom is about 90°. Such angle of the inkribbon 6 may be changed to any other angles provided the rotary member 10 can frictionally be driven by the inkribbon 6. In the above embodiment, all of the detector 5 and the guide rollers 4 are arranged on the carrier 1. Alternatively, these detector and guide rollers may also be arranged on the cassette 7.

In addition, it is a matter of course that use may be made of an inkribbon taken up and delivered from spools instead of the above described endless inkribbon 6.

Moreover, it is possible to use any optical or mechanical means for generating the reset signal $\phi R$. In short, various changes and alternations may be made without departing the essential feature of the invention.

As stated hereinbefore, the invention is capable of stopping the rotation of the rotary member 10 during the operation of the printer when the travel of the inkribbon 6 becomes stopped owing to trouble induced therein. In this case, the signal generation means functions to deliver no signal which is detected by the detector 5, thereby stopping the operation of the printer. As a result, it is possible to repair the inkribbon 6 such that it can be used again. Thus, the device according to the invention is an improved one which can precisely detect the travel condition of the inkribbon 6, which is simple in construction and which can be manufactured in a less expensive manner. In addition, the travel condition of the inkribbon 6 can be detected near the front end of the printer head, so that the detection can be effected prior to the degradation of the type quality even when trouble is induced in the inkribbon 6.

When the trouble occurs in the detector 5 itself, the reset signal $\phi R$ is not delivered from the detector 5 to the preset counter 35 to cause the alarm or automatic stop device 37 to operate. As a result, the use of detection of the travel condition of the inkribbon 6 provides the advantage that provision is made of a so-called fail-safe mechanism which functions to indirectly detect the trouble induced in the detector 5 itself.

In addition, the invention is capable of detecting the running condition of the carrier 1. As a result, there is a risk of the carrier 1 malfunctioning improper by jamming of the record sheet, poor return movement of head wires and improper guiding due to dust adhering to the inkribbon 6. In this case, it is also possible to indirectly detect the running condition of the carrier 1 by detecting the travel condition of the inkribbon 6. That is, the bad running of the carrier 1 results in an abnormal character imprint which can be alarmed to the operator or which can be prevented by automatically stopping the running of the carrier 1.

If the inkribbon 6 is taken up and delivered from spools so as to reciprocally travel it, the device according to the invention may be used for a so-called spool inkribbon as a reversing mechanism for detecting a suitable timing of the travel of the inkribbon or counting the reset signal $\phi R$, thereby reversing the direction of travel of the inkribbon. Such reversing mechanism according to the invention provides an electrical reversing mechanism which is reliable in operation and simple in construction and hence is far superior to the prior art reversing mechanism.

As stated hereinbefore, the printer provided with the device according to the invention is capable of reliably feeding the inkribbon and improving the reliability of a printer as a whole. Thus, the printer is significantly useful for imprinting bank books, checks, ledgers, and other important documents without failure.

What is claimed is:

1. In a printer having:

a pulse motor rotatable by a particular angle responsive to a driving pulse;

pulse generating means for generating driving pulses for said pulse motor; and carrier means for a printer head, the carrier means reciprocated adjacent a printing medium by said pulse motor;

the improvement comprising:

a device for detecting a travel condition of an inkribbon comprising:

(a) means associated with said carrier means for feeding said inkribbon in response to reciprocation of said carrier by said pulse motor;

(b) means for generating a detection signal responsive to each predetermined amount of travel of said inkribbon, said means for generating a detection signal being engaged by and movable in response to travel of said inkribbon, (c) preset counter means for comparing the number of said driving pulses generated between successive ones of said detection signals with a predetermined value, said preset counter means having:

(1) a first count input receiving said driving pulses, (2) a second reset input receiving said detection signal for resetting a count number while counting; and (3) an output for transmitting a signal upon said preset counter means reaching a preset value;

(d) a gate circuit connected between said pulse generating means and means responsive to said output signal of said preset counter means for detecting a return operation of said carrier and for preventing said driving pulses from being input to said preset counter means;

whereby an output signal is generated by said preset counter means whenever a predetermined number of driving pulses is generated for reciprocating said carrier means and for feeding said inkribbon without generation of a detection signal indicative of inkribbon travel.

2. In a printer having:

a pulse motor rotatable by a particular angle responsive to a driving pulse;

pulse generating means for generating driving pulses for said pulse motor; and carrier means for a printer head the carrier means reciprocated adjacent a printing medium by said pulse motor;

the improvement comprising:

a device for detecting a travel condition of an inkribbon comprising:

(a) means associated with the carrier means comprising a transmission means for transmitting an output of the pulse motor to a drive roller for feeding the inkribbon responsive to relative motion between the carrier means and a body of the printer;

(b) the drive roller being controlled by a oneway operating member transmitting said output of the pulse motor in one direction so as to supply the drive roller with rotation force to feed the inkribbon during the motion of the carrier means in said one direction only;

(c) means driven by the inkribbon for generating a detection signal responsive to each predetermined amount of travel of the inkribbon, the means for generating a detection signal being engaged by and movable in response to travel of the inkribbon, thereby generating said detection signal when said inkribbon is driven in said one direction (d) preset counter means for comparing the number of said driving pulses generated between successive ones of said detection signals with a predetermined value, the preset counter means having:

(1) a first count input receiving said driving pulses, (2) a second reset input receiving the detection signal for resetting a count number while counting, and (3) an output for transmitting a signal upon the preset counter means reaching a preset value, whereby an output signal is generated by the preset counter means whenever a predetermined number of said driving pulses is generated for reciprocating the carrier means and for feeding the inkribbon without generation of a detection signal indicative of inkribbon travel.

3. A printer as recited in claims 1 or 2 further comprising an alarm means for receiving said output signal transmitted by said preset counter means, for providing an alarm whenever a predetermined number of driving pulses is generated for reciprocating said carrier means and for feeding said inkribbon without generation of a detection signal indicative of inkribbon travel.

4. A printer as recited in claim 1 or 2 further comprising automatic stop means receiving said output signal transmitted by said preset counter means, for stopping said printer whenever a predetermined number of driving pulses is generated for reciprocating said carrier means and for feeding said inkribbon without generation of a detection signal indicative of inkribbon travel.

5. A printer as recited in claim 1 or 2 wherein said means for generating a detection signal comprises a rotary member, rotating in accordance with the travel of said inkribbon, a magnet associated with said rotary member, and a reed switch arranged for responding to said magnet and for generating said detection signal.

6. A printer as recited in claim 1 wherein said means associated with said carrier comprises a transmission means for transmitting an output of said pulse motor to a drive roller for feeding said inkribbon responsive to relative motion between said carrier means and a body of said printer.

7. A printer as recited in claim 1 or 2 further comprising means for selectively inhibiting reception of said driving pulses by said preset counter means, whereby said output signal is not transmitted during return operation of said carrier.

8. A printer as recited in claim 7 wherein said means for selectively inhibiting comprises a gate circuit.

9. A printer as recited in claim 2 further comprising a gate circuit connected between said pulse generating means and means responsive to said output signal of said preset counter means for detecting a return operation of said carrier and for preventing said driving pulses from being input to said preset counter means.

* * * * *